US009454877B2

(12) United States Patent
Lamendola et al.

(10) Patent No.: US 9,454,877 B2
(45) Date of Patent: Sep. 27, 2016

(54) GAME AND GAMING MACHINE HAVING BINGO-TYPE BONUS EVENT

(71) Applicant: Real Networks, Inc., Seattle, WA (US)

(72) Inventors: Eric Lamendola, Clark, NJ (US); Craig Falciglia, Waldwick, NJ (US)

(73) Assignee: Gamings Realms, PLC, London (GB)

( * ) Notice: Subject to any disclaimer, the term of this patent is extended or adjusted under 35 U.S.C. 154(b) by 0 days.

(21) Appl. No.: 14/151,098

(22) Filed: Jan. 9, 2014

(65) Prior Publication Data

US 2015/0194020 A1 Jul. 9, 2015

(51) Int. Cl.

| | |
|---|---|
| ***G07F 17/34*** | (2006.01) |
| ***G07F 17/32*** | (2006.01) |
| *A63F 3/06* | (2006.01) |

(52) U.S. Cl.
CPC ..... *G07F 17/3286* (2013.01); *G07F 17/3267* (2013.01); *A63F 3/0645* (2013.01)

(58) Field of Classification Search
CPC ..... G07F 17/32; G07F 17/3244; G07F 17/3258; G07F 17/3267; G07F 17/3286; A63F 3/06; A63F 3/062; A63F 3/0645; A63F 3/081
See application file for complete search history.

(56) References Cited

U.S. PATENT DOCUMENTS

| | | | | |
|---|---|---|---|---|
| 5,393,057 | A | 2/1995 | Marnell, II | |
| 5,647,798 | A | 7/1997 | Falciglia | |
| 6,338,678 | B1 | 1/2002 | Seelig et al. | |
| 6,609,973 | B1 | 8/2003 | Weiss | |
| 6,832,956 | B1 | 12/2004 | Boyd et al. | |
| 7,056,212 | B2 | 6/2006 | Boyd et al. | |
| 8,070,587 | B2 | 12/2011 | Davis et al. | |
| 8,540,562 | B2 | 9/2013 | Roper et al. | |
| 2009/0111560 | A1* | 4/2009 | Davis | G07F 17/32 463/20 |

OTHER PUBLICATIONS

International Search Report for PCT/US15/10481, mailed Mar. 26, 2015, 2 pages.
Written Opinion of the International Search authority for PCT/US15/10481, mailed Mar. 26, 2005, 5 pages.

* cited by examiner

*Primary Examiner* — Damon Pierce
(74) *Attorney, Agent, or Firm* — Weide & Miller, Ltd.

(57) ABSTRACT

A main or base game has an associated bingo-type matching bonus game or event. The main or base game may have a winning outcome with an associated base award. Upon the occurrence of certain events, such as matches of symbols used in the main game, one or more bonus indicia, such as bingo balls, are generated. These bonus indicia are compared to a player's bonus indicia, such as bingo numbers on a player's bingo card, for matching. If one or more designated matches, such as matching patterns, are achieved, the player may be awarded a bonus event award.

20 Claims, 3 Drawing Sheets

| Trigger(s) | Balls Drawn |
|---|---|
| 1 | 1 |
| 2 | 2 |
| 3 | 4 |
| 4 | 5 |
| 5 or more | 8 |

| Trigger(s) | Balls Drawn |
|---|---|
| 1 | 1 |
| 2 | 2 |
| 3 | 4 |
| 4 | 5 |
| 5 or more | 8 |

GAME AND GAMING MACHINE HAVING BINGO-TYPE BONUS EVENT

FIELD OF THE INVENTION

The present invention relates to methods of presenting and playing games, and most particularly wagering-type games.

BACKGROUND OF THE INVENTION

A wide variety of casino-style games are known. Game designers are constantly seeking games which are exciting to the player and thus retain the player's interest and desire to play the game.

A new and improved game is desired.

SUMMARY OF THE INVENTION

Embodiments of the invention comprise methods of playing and presenting games and gaming machines and systems for implementing the methods.

In one embodiment of a method of the invention, the method comprises presenting a base game comprising: displaying base game information via an electronic video display of the gaming machine, the base game information comprising a plurality of base game indicia; and determining an outcome of the base game, wherein if the outcome of the base game is a winning outcome, awarding a base game award to the player; and determining if one or more matching conditions of base game indicia have occurred relative to said base game and, if so: generating at least one bonus game indicia, wherein a number of generated bonus game indicia depends upon a number of the matching conditions, wherein one or more numbers of matching conditions may result in generation of two or more bonus game indicia; comparing the at least one bonus game indicia to a player's bonus game indicia for matches thereto; and if at least one winning configuration of one or more matches has resulted, awarding a bonus event award to the player.

In a preferred embodiment of the invention, the bonus event comprises a bingo-type matching game or event. In such a configuration, the generated bonus indicia comprise representations of bingo balls having associated bingo numbers. Those bingo numbers are compared to a player's bingo numbers associated with one or more bingo cards. In the event of designated matches of the player's bingo numbers, such as designated rows, columns, diagonals or other patterns, the player is awarded a bonus award.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of playing and presenting games. In a preferred embodiment, the methods of game play and presentation are implemented via a gaming machine or device. Such a gaming machine may have various configurations.

The gaming machine may be located at a casino (and as such may be referred to as a "casino gaming machine"). As described below, the gaming machine may be part of a gaming system, such as a casino gaming system which links multiple of the gaming machines, one or more table games and other devices such as kiosks, accounting systems or servers, progressive systems or servers, player tracking systems or servers or the like.

Figure 1:
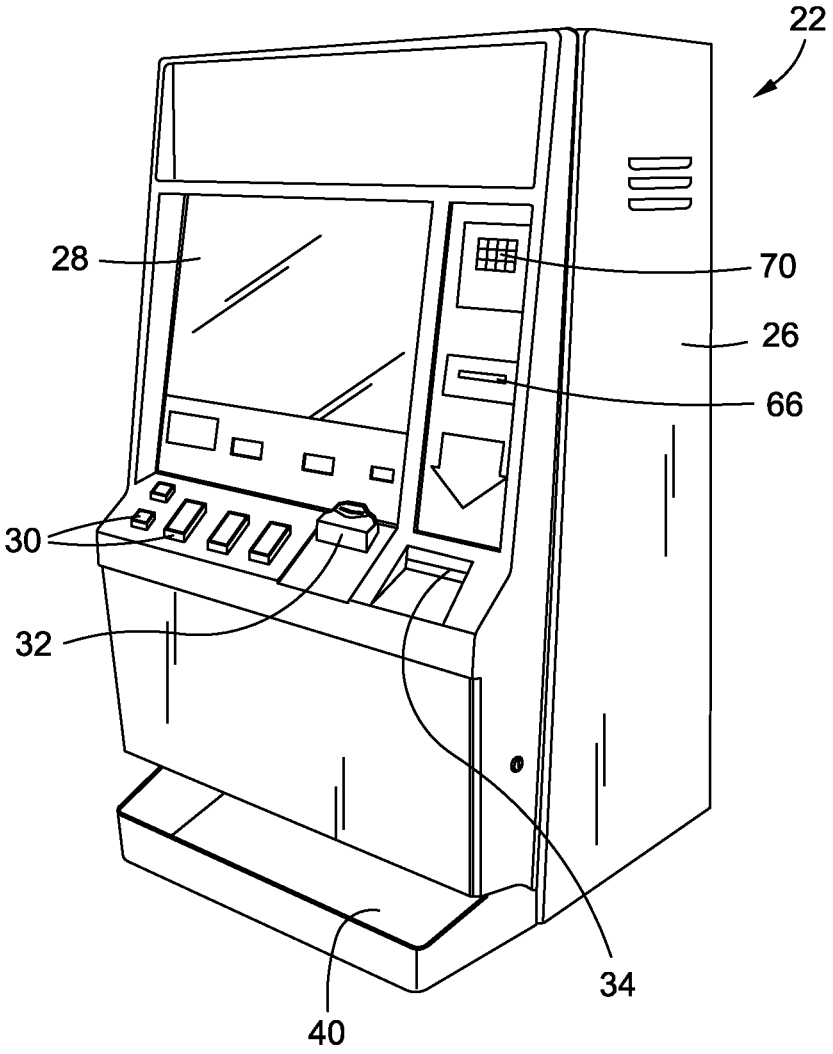
FIG. 1 illustrates one embodiment of a gaming machine configured to present a game of the present invention.

One configuration of a gaming machine 22 for implementing games of the invention is illustrated in FIG. 1. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events.

In another embodiment, the display device 28 may comprise one or more physical reels capable of displaying symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels.

Preferably, the controller is arranged to either turn off the signal to the device(s) effecting the rotation of each or all of the reels or generates a signal for activating a braking device, whereby the reels are stopped. As is well known, the combinations of reel positions and their odds of hitting are associated with the controller, and the controller is arranged to stop the reels in a position displaying a combination of indicia as determined by the controller based on the combinations and odds. The principal of such an arrangement is described in U.S. Pat. No. 4,448,419 to Telnaes, which is incorporated herein by reference. For example, the base symbols might be associated with spinning reels. Sets of base symbols might be generated by spinning those reels.

It will be appreciated that the gaming machine 22 may include more than one display 28, such as two or more electronic video displays, sets of spinning reels and an electronic video display, or other combinations of displays.

As described in more detail below, the gaming machine 22 is preferably configured to present one or more games upon a player making a monetary payment or wager. In this regard, as described in more detail below, the gaming machine 22 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to indicate cards to be held or discarded, to "cash out" of the gaming machine, or to provide various other inputs. Of course, the types of input devices might vary, such as depending upon the type of device which comprises the gaming machine 22. For example, when the gaming machine comprises a mobile communication device, the input may comprise a touch screen display of the device, a keypad or the like.

In one preferred embodiment, the gaming machine 22 includes at least one microprocessor or controller for controlling the gaming machine, including receiving player input and sending output signals for controlling the various components of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 (such as information representing images of displayed cards, symbols, bingo balls or the like), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 22 may also include one or more random number generators for generating random numbers, such as for use in selecting cards and for presenting the game in a random fashion.

Preferably, the controller is configured to execute machine readable code or instructions which are configured to implement the method of game play of the invention. For example, the controller of the gaming machine 22 may be configured to detect a wager, such as a signal from a player's depressing of the "bet one" button. Upon such an event and/or the player otherwise signaling the gaming machine to present the game, the controller may be configured to cause information regarding a base game and/or a bonus game as described below, to be displayed on the at least one display 28. The controller may accept input from a player via the one or more player input devices of the gaming machine 22.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine). In one embodiment, one or more gaming machines 22 may be linked or associated, such as directly or through one or more servers or other devices, such as to present games of the invention in multi-player fashion. Linked gaming machines 22 might share one or more common displays, such as to show multi-player game activity, standings or the like.

As indicated, the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 22 may also include a player tracking device, such as a card reader 66 and associated keypad 70. Such player tracking devices are well known and may permit the game operator to track play of players of the gaming machine. The tracked play may be utilized to offer player bonuses or awards.

It will be appreciated that the gaming machine illustrated in FIG. 1 is only exemplary of one embodiment of a gaming machine. For example, it is possible to for the gaming machine to have various other configurations, including different shapes and styles and having different components than as just described.

For example, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays. The games of the invention could also be presented by or at hand-held devices, such as PDAs, cellular phones, tablet computing devices or the like.

A casino may have numerous such gaming machines 22, such as located on a casino floor or in other locations. Of course, such gaming machines 22 might be used in other environments, such as an airport, a bar or tavern or other locations.

Figure 2:
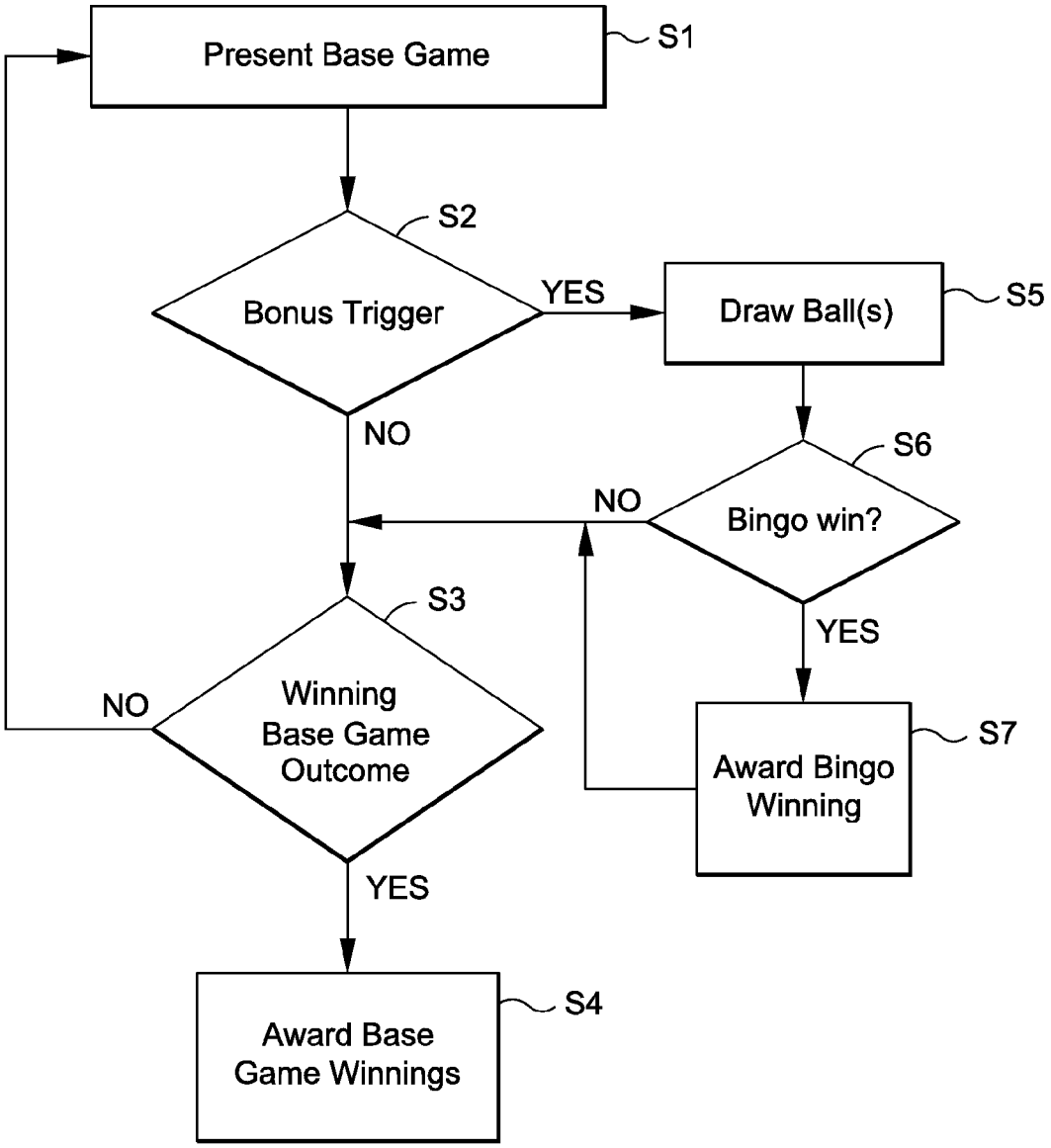
FIG. 2 is a flow diagram of one embodiment of a method of presenting a game in accordance with the present invention.

Other aspects of the invention comprise methods of presenting and/or playing one or more games. One embodiment of a method of game play will be described with reference to FIG. 2.

In one embodiment, in a step S1, a main or base game is presented to a player. In a preferred embodiment, games of the invention are presented as wagering games. As such, a player may be required to place one or more wagers in order to play one or more games. For example, a player might be required to place a minimum bet of monies, credits, points or the like in order to play each game or a set of two or more games. The size and frequency of the wager may vary. In the case of the gaming machine 22 described above, the player might provide a monetary value ticket, coins, bills or the like to the gaming machine 22, thus establishing a number of monetary value credits with the gaming machine 22. The player may wager one or more of those credits to play the game.

After any required wager has been placed by the player and received by the gaming machine 22, casino gaming system, house/casino or the like, the game is preferably presented to the player. In a preferred embodiment, the main or base game comprises the display of main or base game information to the player. In the case of the gaming machine 22 illustrated in FIG. 1, the information may be displayed via the one or more displays 28.

The main or base game has a number of potential outcomes. One or more, but not all of those outcomes are preferably designated as winning outcomes. The one or more winning outcomes may have associated awards or winnings, such as one or more credits or monetary awards, such as defined by a pay table of winning outcomes and awards.

The main or base game may have a variety of configurations and/or comprise various games. For example, the main or base game may be a game of video poker, spinning reel slots, video slots, blackjack, solitaire, mahjong, or other games now known or later developed. The main or base game information which is presented to the player may thus depend on the configuration of the main or base game. For example, if the main or base game is a game of video poker, images of cards are displayed to the player. If the main or base game is a game of spinning reel slots, physical slot reels may rotate and display slot symbols.

As described below, the game of the invention preferably includes a bingo-type matching game or event played relative to the main or base game. The bingo-type matching event of the invention is most advantageously presented relative to a base or main game in which some aspect of player input, such as player skill, is used to determine the outcome of the main or base game. In one preferred configuration, groups of main game indicia are displayed, such as in matrix or other form, and the player has the opportunity to attempt to achieve matches of the main or base game symbols. One example of such a gaming is the game known as Bejeweled, wherein a matrix of varying symbols is displayed and a player has the opportunity to change the position of symbols in order to achieve combinations of three or more symbols aligned along rows or columns of the matrix.

In one embodiment, one or more triggers are defined relative to the main or base game. As described below, the one or more triggers preferably result in the selection or generation of bonus game indicia relative to the bonus game or event. As indicated above, in a preferred embodiment the bonus event is a bingo-type matching game and the bonus indicia comprise bingo balls having associated bingo-type indicia.

The triggers may comprise one or more of the winning outcomes of the main or base game, but as described below, the trigger(s) may comprise other outcomes or aspects of the main or base game. In a step S2, it is determined if any such triggers occurred.

If not, then in a step S3, the main or base game is simply evaluated to determine if it is a winning or losing outcome. If the main or base game is a losing outcome, the game preferably ends (and the player may elect to play another game). If the main or base game is a winning outcome, then in step S4 the player is preferably awarded winnings, such as in accordance with the pay table. As indicated above, the winnings might comprise one or more credits, monies, points or other types of awards.

If in step S2 a trigger occurred, then in a step S5, one or more bonus indicia are generated relative to the bonus game or event. In a preferred embodiment, the bonus indicia are bingo balls which bear bingo numbers for matching to a player's bingo numbers which are associated with one or more bingo cards. Preferably, the bonus indicia are randomly selected or generated and are displayed to a player relative to the player's bonus game indicia.

As indicated, in the preferred embodiment, the player's bonus game indicia comprise bingo numbers which are associated with one or more bingo cards. The object of the bonus game or event is for the player to achieve matches of certain of their bingo numbers to the drawn bingo numbers.

It will be appreciated that the bingo-style matching event may be played in the form of a standard bingo game which uses bingo indicia in the form of a letter and number (such as the combinations of the letter B with the numbers 1-15, I with the numbers 16-30, N with the numbers 31-45, G with the numbers 46-60 and O with the numbers 61-75). However, the game might be played with other combinations of letters and numbers, other indicia/symbols, or just letters or just numbers. In all cases, the bonus game or event preferably has as the object thereof the matching of designated player bonus game indicia with selected or drawn bonus game indicia resulting from the base or main game trigger. Thus, the player's bonus game indicia might comprise bingo numbers associated with a bingo card, or other types of bonus game indicia and bonus game indicia which may be displayed in other manners, such as in rows, columns, a matrix, a pyramid or other configurations.

In most preferred embodiment of the invention, the number of bonus game indicia which is drawn or selected as a result of the trigger may vary. In the preferred embodiment of the game, the trigger comprises the matching of one or more symbols or indicia in the base or main game. Greater numbers of such matches preferably result in additional or greater numbers of bonus game indicia being generated.

For example, relative to a game in which multiple symbols are displayed (such as the above-referenced game of Bejeweled or spinning reel or video slot games), the number of pairs (or other numbers, such as 3 or more, 4 or more, etc.) of matching symbols which are displayed to the player in the main or base game preferably determines the number of bonus game indicia. In the case of video poker, the number of matching cards in the player's card hand may determine the number of bonus game indicia which is generated. As another example, a player's poker hand value could determine the number of bonus game indicia. As one example, a lower ranked hand such as Full House might result in one bonus game indicia, while a higher ranked hand such as a Flush might result in multiple bonus game indicia.

The "matches" of base game symbols which trigger the one or more bonus game indicia may or may not be associated with or comprise a winning base game outcome, or such combinations may have to be a portion of, or comprise, a winning main or base game outcome. Further, such symbols may or may not be required to be on an active pay line of the main or base game or meet or criteria. In other embodiments, the matches or combinations of main or base game symbols may be required to meet certain criteria, such as extending along certain paylines or in certain orientations (such as only along rows and/or columns, but not diagonals; or requiring the symbols to be in adjacent/connecting locations and not simply scattered along a payline, etc.)

Figures 3, 4:
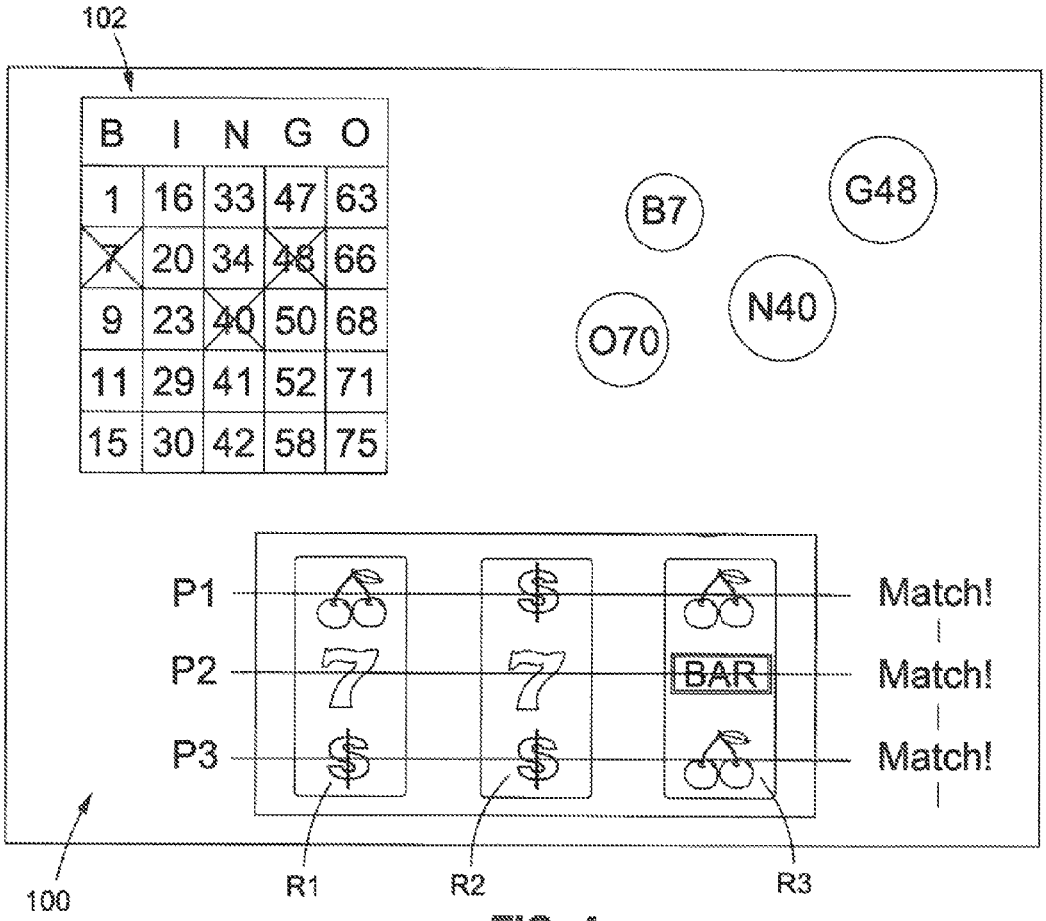
FIG. 3 illustrates one embodiment of table illustrating a number of bingo balls generated for particular base game outcomes in accordance with the present invention.
FIG. 4 illustrates one example of a game in accordance with the present invention.

FIG. 3 illustrates one embodiment of a table which shows an embodiment of the correlation between main or base game triggers and the number of generated bonus event indicia. In this embodiment, a player attempts to achieve matches of symbols in the main or base game. For a single match of symbols, one bonus indicia is selected. For two matches, two bonus indicia are selected. For three matches, four bonus indicia are selected. For four matches, five bonus indicia are selected, and for five or more matches, eight bonus indicia are selected.

Of course, other relationships of matches to bonus indicia may be provided. While such relationships may be linear, in a preferred embodiment a player is awarded more bonus indicia for less probable outcomes of the main or base game (i.e. greater numbers of matches). In one embodiment, certain numbers of triggers may result in a sufficient number of bonus indicia being generated to result a minimum number of matches, such as the matches of all of the player's bonus game indicia to form a bonus game outcome (thus guaranteeing the player a bonus game win). For example, 5 triggers or matches of symbols in the main or base game might result in a sufficient number of bonus indicia being generated until all of the player's bonus indicia along a row, a column, a diagonal or other winning combination (such as 4 corners, etc.) results.

The bonus indicia may be generated and presented in various manners. In the most preferred embodiment, the bonus indicia are graphical representations of bingo balls. These bingo balls may be displayed to a player via a video display of the gaming machine. Of course, the bonus game indicia may be displayed in other manners.

In a step S6, it is determined if the outcome of the bingo-type matching bonus event is a win. In a preferred embodiment, this comprises determining if the player achieved a winning combination of matches of one or more of the selected bonus indicia to their bonus indicia. Relative to the bingo-type game of the invention, this may comprise determining of the player achieved a particular pattern of matches, such as completing a row, column, diagonal, four corners or other combination of matches relative to the player's bingo card/indicia.

If the player did not receive a winning bonus game outcome, the game may proceed with the evaluation of the base or main game, as described above relative to steps S3 and S4. If the player did receive a winning bonus game outcome, then in a step S7, the player may be awarded bonus game winnings. The bonus game winnings may be fixed or might vary. In some instances, multiple bonus winning outcomes are defined and those outcomes may have various associated bonus awards, such as again defined by a bonus event pay table. Once again, if the player is awarded any bonus award, then the main or base game is still preferably evaluated for winning and losing outcomes as described above.

If the outcome of the bonus game or event is not winning, the player is preferably allowed to play one or more additional main or base games in an attempt to achieve additional triggers and thus additional bonus indicia for matching (i.e. earlier matches are still indicated and a player may build upon those earlier matches). If the outcome of the bonus game or event is winning, the player's bonus indicia are preferably cleared, such as by assigning a player a new bingo card at the beginning of the next main or base game.

It will be appreciated that the method of playing and presenting the game may have other features or steps. In addition, the above-referenced steps might have other orders than as specifically described herein.

One example of a method of playing and presenting a game will be described with reference to FIG. 4. FIG. 4 illustrates a graphical game display as might be presented by a video display 28 of the gaming machine 22 described above.

In this example, the base game comprises a game of video slots. The game thus involves the display of a set of base symbols 100. In this example, three graphically represented reels R1, R2 and R3 are configured to each display three slot symbols, such that the base slot game outcome is determined relative to nine displayed slot symbols. Of course, the base game might utilize other numbers of reels, symbols per reel or the like.

In one embodiment, the base game symbols may be displayed relative to one or more paylines, such as paylines P1, P2 and P3. Of course, other configurations or combinations of paylines may be utilized. In one embodiment, winning outcomes (if any) of the base game are determined relative to these paylines (or those of the paylines which are active). In addition, matches of symbols which trigger the generation of bonus indicia are also evaluated relative to these paylines.

In this example, the trigger for generating one or more bonus indicia comprises the receipt of two or more matching symbols along an active payline. In this example, the player has achieved matching "cherry" symbols along payline P1, matching "7" symbols along payline P2, and matching "$" symbols along payline P3, for a total of three matches.

In a configuration where the table of FIG. 3 is utilized, 4 bonus indicia are generated as a result of the player achieving 3 matches. As illustrated in FIG. 4, four bingo balls have thus been generated and displayed to the player. These balls comprise bingo balls bearing the bingo game numbers B7, G48, O70 and N40.

These bingo balls/numbers are compared to one or more player numbers. As illustrated, the graphical display may include a representation of one or more bingo cards 102. Again, the configuration of the bingo card 102 may depend upon the particular style of the bingo-type matching game. The generated bingo numbers are compared to the player's numbers. In this case, the player has matched B7, N40 and G48.

As this point, the player has not yet achieved a winning bingo pattern. The player may thus play one or more additional occurrences of the base game in an attempt to achieve a bingo bonus game win.

Preferably, the base game is also evaluated for winning outcomes. As one example, the combination of three "cherries" relative to any of the active paylines might comprise a winning outcome. In this case the player would thus be awarded base game winnings for that winning base game outcome.

Various other embodiments of the invention are contemplated. For example, in one embodiment, a player might be required to place a base wager in order to play the main or base game and be required to place an additional wager to play the bingo-type matching bonus event. For example, a player might wager 1-5 credits upon the main or base game (wherein the number of credits determines the size of any winning outcome of the main or base game). The player might place a separate wager to "buy" a bingo card. Once purchased, the bingo card might remain active for all main or base games until a bonus event win is achieved. In other embodiments, a player might be require to place an additional wager each time the player desires the opportunity to have triggers resulting from the main or base game to generate bonus indicia for play in the bonus event.

It will also be appreciated that a player might be assigned or purchase two or more sets of player bonus indicia, such as two or more bingo cards. In this manner, the player may attempt to win a bonus award via each bingo card.

The invention has a number of advantages. A particular advantage of the game is that the game has added excitement owing to the addition of the bingo-type matching bonus event. Instead of the player only having the chance for main or base game wins, the player has the additional opportunity for bonus event wins.

The configuration of the bonus event of the invention has the advantage of promoting the play of multiple main or base games. In particular, once a player receives several matches in the bonus event, the player is enticed to play additional main or base games in an attempt to achieve one or more remaining matches necessary for a main game win.

One exciting feature of the game is that in various embodiments, the generated bonus indicia are different than the indicia which are used in play of the base game. Thus, for example, a player may be presented with a base game of slots or video poker and the bonus event comprises an entirely different bingo or other matching game. This contrasts, for example, with U.S. Pat. No. 5,393,057 which discloses a game having a secondary feature where players attempt to utilize indicia in the base game in the secondary event. In the game of the invention, the generated bonus indicia are entirely different than the base game indicia, thus raising the excitement surrounding the bonus event.

A most particular advantage of the game is the excitement that a single main or base game outcome may generate multiple bonus indicia and even a bonus game win via a single play of the main or base game. As described above, as a result of a single main or base game, triggers might occur which result in the generation of multiple bonus indicia and even sufficient bonus indicia necessary to result in a bonus event win. The player thus realizes that each main or base game has the opportunity for moving them quickly towards a bonus event win (rather than very slowly over time), thus increasing their desire to play the main or base game.

For example, U.S. Pat. No. 6,609,973 discloses a slot-type game having a bingo game feature. In the event the base game is a designated outcome, then one or more physical bingo balls are selected for play by the player. First, such a configuration is generally unworkable relative to electronic gaming machines, Internet-enabled games and the like where such a ball selector cannot be utilized. In addition, a bingo ball is simply selected upon receiving a particular outcome. Thus, a player can anticipate receiving a single ball as a result of the base game. In accordance with the present invention, a player might receive multiple bonus indicia as a result of the play of a single base game.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of presenting a game to a player of a gaming machine having a wager accepting device, at least one electronic video display and at least one player input device, comprising the machine-implemented steps of:

assigning said player at least one bonus game card to be used in conjunction with play of one or more base games, said at least one bonus game card having associated bonus game indicia:

displaying said at least one bonus game card to said player via said at least one electronic video display;

a. presenting a base game comprising:

displaying base game information via said at least one electronic video display of said gaming machine, said base game information comprising a plurality of base game indicia; and determining an outcome of said base game, wherein if said outcome of said base game is a winning outcome, awarding a base game award to said player;

b. determining if one or more matching conditions of base game indicia have occurred relative to said base game and, if so:

generating and displaying via said at least one electronic video display at least one bonus game indicia, wherein a number of generated and displayed bonus game indicia depends upon a number of said matching conditions, wherein one or more numbers of matching conditions may result in generation of two or more bonus game indicia; and designating matches to said at least one bonus game card by comparing said at least one generated bonus game indicia to the bonus game indicia associated with the at least one bonus game card assigned to said player for matches thereto; and c. if at least one winning configuration of one or more matches of bonus game indicia associated with at least one of said bonus game cards has resulted, awarding a bonus game award to said player, and if not, repeating steps a. and b. at least once relative to the same at least one bonus game card and awarding a bonus game award to said player if at least one winning configuration of matches of bonus game indicia has occurred as a result of the play of the multiple base games.

2. The method in accordance with claim 1 wherein said gaming machine comprises a computer or mobile electronic device.

3. The method in accordance with claim 1 wherein the number of generated bonus game indicia varies depending upon the number of matching conditions of base game indicia.

4. The method in accordance with claim 1 wherein said at least one generated bonus game indicia comprises a graphical representation of one or more bingo balls bearing bingo numbers.

5. The method in accordance with claim 4 wherein said at least one bonus game card having associated bonus game indicia comprises at least one bingo card bearing bingo numbers.

6. The method in accordance with claim 5 wherein said at least one bingo card is randomly selected and assigned to said player.

7. The method in accordance with claim 1 wherein said matching condition of base game indicia comprises three or more matching base game indicia.

8. The method in accordance with claim 7 wherein said matching base game indicia occur along a row or a column of a matrix of said base game indicia.

9. The method in accordance with claim 7 wherein said matching base game indicia occur along at least one active payline.

10. The method in accordance with claim 1 wherein said number of bonus game indicia increases non-linearly to said numbers of matching conditions of base game indicia.

11. The method in accordance with claim 1 wherein said base game is a skill based game in which said outcome depends in part upon one or more inputs from said player.

12. A gaming machine configured to present a game to a player comprising:

a controller;

at least one electronic video display;

at least one player input device;

machine-readable code executable by said controller to assign said player at least one bonus game card having associated bonus game indicia and cause said at least one electronic video display to display said at least one bonus game card;

machine readable code executable by said controller to cause said at least one electronic video display to display base game information, said base game information comprising a plurality of base game indicia;

machine-readable code execute by said controller to determine an outcome of said base game, wherein if said outcome of said base game is a winning outcome, said gaming machine is configured to award a base game award to said player;

machine-readable code executed by said controller to determine if one or more matching conditions of base game indicia have occurred relative to said base game and, if so:

generating at least one bonus game indicia and displaying said bonus game indicia on said at least one electronic video display, wherein a number of generated bonus game indicia depends upon a number of said matching conditions, wherein one or more numbers of matching conditions may result in generation of two or more bonus game indicia; and comparing said at least one generated bonus game indicia to the bonus game indicia associated with the at least one bonus game card assigned to said player; and machine-readable code executed by said controller to award a bonus award to said player if at least one winning configuration of one or more matches of bonus game indicia associated with at least one of said bonus game cards has resulted, and if not, to present at least one additional base game instance relative to the same at least one bonus game card and award a bonus game award to said player if at least one winning configuration of matches of bonus game indicia has occurred as a result of the play of the multiple base games.

13. The gaming machine in accordance with claim 12 wherein said gaming machine comprises a player's computer.

14. The gaming machine in accordance with claim 12 wherein said gaming machine comprises a player's mobile electronic device.

15. The gaming machine in accordance with claim 12 wherein said at least one generated bonus game indicia comprises a graphical representation of one or more bingo balls bearing bingo numbers.

16. The gaming machine in accordance with claim 15 wherein said at least one bonus game card comprises at least one bingo card bearing bingo numbers.

17. The gaming machine in accordance with claim 16 at least one bingo card is randomly selected and assigned to said player.

18. The gaming machine in accordance with claim 12 wherein said matching condition of base game indicia comprises three or more matching base game indicia.

19. The gaming machine in accordance with claim 12 wherein said base game is a skill based game in which said outcome depends in part upon one or more inputs from said player to said gaming machine.

20. The gaming machine in accordance with claim 12 wherein the number of generated bonus game indicia varies depending upon the number of matching conditions of base game indicia.

* * * * *